US005742733A

United States Patent [19]

Jarvinen

[11] Patent Number: 5,742,733

[45] Date of Patent: Apr. 21, 1998

[54] PARAMETRIC SPEECH CODING

[75] Inventor: Kari Juhani Jarvinen, Tampere, Finland

[73] Assignees: Nokia Mobile Phones Ltd., Salo; Nokia Telecommunications Oy, Espoo, both of Finland

[21] Appl. No.: 382,875

[22] Filed: Feb. 3, 1995

[30] Foreign Application Priority Data

Feb. 8, 1994 [FI] Finland ..... 940577

[51] Int. Cl.[6] ..... G10L 3/02

[52] U.S. Cl. ..... 395/2.29; 395/2.28

[58] Field of Search ..... 395/2.29, 2.31, 395/2.39, 2.28

[56] References Cited

U.S. PATENT DOCUMENTS

| | | | |
|---|---|---|---|
| 4,752,956 | 6/1988 | Sluijter | 381/38 |
| 5,018,200 | 5/1991 | Ozawa | 381/36 |
| 5,115,469 | 5/1992 | Tanigushi et al. | 381/36 |
| 5,483,668 | 1/1996 | Malkamaki et al. | 455/33.2 |
| 5,517,511 | 5/1996 | Hardwick et al. | 371/37.4 |
| 5,579,433 | 11/1996 | Jarvinen | 395/228 |

OTHER PUBLICATIONS

Leich, H., "Technique De Codage De La Parole", Revue HF, vol. 17, No. 1/02/03, 1 Jan. 1993, pp. 37–50.

Lee, Hwang S. et al., "A Vector Quantization Adaptive Predictive Coder", IEEE Aug. 1987, vol. 3, pp. 1272–1277.

ICASSP 90. Tseng, "An analysis–by–synthesis linear predictive model for narrowband speech coding", pp. 209–212, vol. 1 Apr. 1990.

*Primary Examiner*—Allen R. MacDonald
*Assistant Examiner*—Richemond Dorvil
*Attorney, Agent, or Firm*—Perman & Green, LLP

[57] ABSTRACT

This invention is a new kind of parametric speech coding system in which the parametrization according to a speech production model is carried out not only on the speech signal to be coded but also on the decoded, that is, synthesized speech signal. A parametric representation (207) of the synthesized signal is compared with a parametric representation (203) of the original speech signal and the coding functions are controlled according to their difference. At first, parametrization (205) according to the speech production model used in the encoding is carried out on the decoded speech signal. Next, the parameter values formed from the synthesized speech signals are compared (204) with the parameter values (203) calculated, in the encoder, from the speech signal to be coded. A known distance measure can be used in carrying out the comparison. The coding functions are controlled by means of a shaping block (202) in such a way that the difference indicated by the distance measure is made as small as possible.

17 Claims, 3 Drawing Sheets

PARAMETRIC SPEECH CODING

FIELD OF THE INVENTION

This invention relates to coding a speech signal in a coder in which a speech production model is used to calculate the excitation of the synthesis filters and the parameters of the audio channel. In the decoder of a receiver, a synthesized speech signal is generated by means of a derived excitation.

BACKGROUND OF THE INVENTION

In digital mobile phone systems, each phone has a speech coder/decoder (codec) which codes the speech to be transmitted and decodes the received speech. In present coding methods, which are combinations of waveform coding and vocoding, the compression of the signal takes place by using adaptive prediction to eliminate the short- and long-term redundance from the speech samples before quantizing the signal.

The coder of a GSM system is called RPE-LTP (Regular Pulse Excitation—Long Term Prediction). It uses LPC (Linear Predictive Coding) for short-term prediction and prediction of the basic frequency, that is, Long Term Prediction, LTP. The latter is used in the speech signal end also in the short-term prediction residual signal to eliminate the pronounced long-term correlation that can be perceived at the time level. In the coder, sampling takes place at an 8 kHz frequency and the algorithm assumes the input frame signal to be 13 bit linear PCM. The samples are segmented into frames of 160 sample each frame having a duration of 20 ms. The coding operations are done on a frame-specific basis or on their subframes (in blocks of 40 samples). As a result of the encoder's coding, from one frame 260 bits are obtained, which are channel-coded, modulated and sent to the receiving end, where they are decoded, yielding 160 decoded speech samples. The operation of the coder is well known to those versed in the art and has been set forth in detail in the specification of the GSM system.

Also known is a type of coder that uses a coding method based on Code Excited Linear Prediction (CELP), which is also known as stochastic coding. In these CELP-type methods the actual speech signal or a residual signal filtered from it are not used as the excitation but this function is taken over by, for example, Gaussian noise, which is filtered (by shaping the spectrum) to produce speech. A certain number of excitation vectors of a given length, which are comprised of random samples, are stored in the code book. These are filtered through the long- and short-term synthesis filters and the reconstructed speech signal thereby obtained is subtracted from the original speech signal. The filter coefficients are obtained by analysing the original speech frame with LPC analysis and, for the LTP, by defining the basic frequency. All the vectors of the code book are gone through and the one with the smallest weighted error is selected. The code letter index (address) of this vector is sent together with the filter parameters to the decoder. It has the same code book as the encoder and a search is made in it, on the basis of the address, for the excitation vector indicated by the index, which excitation vector is filtered to synthesize speech in a corresponding fashion as in the encoder. No actual speech signal is thus transmitted but only filter parameters and a code book index.

In the North-American digital mobile phone system, the VSELP (Vector Sum Excited Linear Production) method is used in the speech coder, this method being in and of itself a method of the CELP type but which is very peculiar as to its code book. It does not permit the use as an excitation of, for example, Gaussian Noise, as in the above-described general coder of the CELP type.

As has been discussed in the above, speech coding systems are typically based on the use of a suitable speech production model. The parameters according to the speech production model are calculated from the speech signal in the encoding that is to be carried out on the transmission side of a coding system of this type. The values of the parameters of the speech production model are quantized and transmitted to the receiver. In the decoding to be carried out in the receiver, the speech signal is synthesized using the speech production model, which is controlled with parameter values obtained from the encoder. In speech coding the most commonly used parametric modelling of speech production is based, in accordance with what has been said above, on linear prediction, that is, the use of the so-called LPC model (Linear Predictive Coding), by means of which the dependence in the speech signal between contiguous samples can be modelled and in addition to which the so-called LTP model (Long Term Prediction) is used, which enables modelling of the long-term dependence, in the speech, between the samples.

Means do not exist for fully modelling a speech signal based solely on LPC and LTP modelling, which means that in order to maintain a good quality speech signal in the coding operation, it has proved necessary to transmit to the receiver not only the parameters according to the two models mentioned but also the difference between the speech signal produced by means of the speech production model that is formed from these and the speech signal to be coded, that is, the modelling error. In a parametric speech coding system, the representation of the speech signal that is to be quantized and transmitted to the decoder is thus made up not only of a group of parameters according to the speech production model (eg, the parameters of the LPC model and the parameters of the LTP model) but also of the difference between the speech signal that is synthesized for said parameter group and the original speech signal, that is, the modelling error. A parametrized representation can be formed from the modelling error or it can be quantized as such sample by sample.

In known speech signal coding methods, a quantization error arises which impairs the quality of the speech signal. In speech coding there is thus a great need to develop kinds of systems which are capable of providing more effective coding in the transmitter. On the other hand, there is a need to develop systems that are capable of improving the quality of the received speech signal during decoding.

In order to carry out the encoding of speech a number of methods have been presented, which seek to provide efficient coding by processing the error signal of the parametric model before quantizing in such a way that a low bit rate can be used to Transmit the error signal. One such method has been presented in U.S. Pat. No. 4,752,956. It deals with a Residual Excitation Linear Prediction (RELP)-type coder in which the residual signal is supplied to a lowpass filter that lowers the sample frequency (decimation). Decimation does indeed serve to reduce the bit rate, but this nevertheless causes in the decoded speech an audible "metallic" background noise that is also called "tonal noise". To eliminate this, the patent proposes the addition to the encoder of the functions of the decoder. That is to say, in accordance with the speech production model used to synthesize the speech signal, as well as of a second LPC analyser whose input is the speech signal synthesized by means of the speech production model that has been added. This added LPC analyser produces other prediction parameters that describe the characteristics of the short-term spectrum of the decoded speech signal. The frequency characteristics of the residual signal of the speech band are shaped according to the calculated second set of predictive parameters in such a way that a more efficient quantization is provided for the residual signal. A further addition to the decoder is an LPC analyser that calculates a third set of predictive parameters which, together with the primary predictive parameters obtained from the encoder, shape the frequency characteristics of the decoded signal. The arrangement eliminates the bothersome metallic background noise, or tonal noise, and enables a reduction in the bit rate.

On the other hand, methods have been developed for speech coding, in which in the encoding a search is made for an efficient quantized representation for the modelling error by means of so-called analysis-synthesis processing. The methods are intended for coders of the CELP type. An example of this is U.S. Pat. No. 4,817,157, which focuses primarily on how the excitation vector can be formed without going through all possible excitation vectors which can be formed by means of the code book.

Various measures can also be carried out in the decoder. To improve the decoding it is of particular significance to develop a system which can be connected, as a discrete entity in the receiver, to the output of the decoder so as to shape the speech signal in such a way that the quality improves. Such a system that is connected to the decoder and improves the speech quality can easily be put into use because it does not change the parameters which have to be transmitted over the transmission path, nor does it raise the bit rate. In order to improve the quality of the decoded speech, so-called pitch filtering methods of this kind have been developed which seek to shape the decoded speech signal so that it sounds better. International patent application WO-91/06093 describes one such method. It is disclosed in that patent application that the decoded speech signal obtained from a decoder according to the prior art is fed to two filters that are connected in tandem: to the first pitch filter and from there to a second adaptive spectral filter whose filter parameters are obtained from the first filter. The nominator polynomial of the transfer function of the adaptive filter is proportional to the parameters of the LPC filter of the decoder and the denominator polynomial has been developed as a function of the nominator polynomial using spectral equalization technology that is known per se. The purpose of this is that the denominator polynomial tracks tile nominator polynomial as well as possible, in which case the specific curve of the spectrum of the filter does not contain abnormal abrupt rises and falls that "plug up" the filter. Poor tracking causes time-dependent modulation in the decoded speech, in which case the speech is not clear.

BRIEF SUMMARY OF THE INVENTION

In a first aspect of the invention there is provided a speech encoder comprising a first parametrization module for determining first prediction parameters corresponding to a speech signal input thereto, an analysis filter module for determining a modelling error corresponding to the speech signal and first prediction parameters, a synthesis filter module for forming a reconstructed speech signal corresponding to the modelling error and the first prediction parameters, a second parametrization module for determining a second set of prediction parameters corresponding to the reconstructed speech signal, a comparison module for forming a comparison signal indicative of a difference between the first and second prediction parameters, and a shaping module for shaping the modelling error such that the difference between the first and second prediction parameters is reduced, and in a second aspect there is provided a method for speech encoding comprising synthesising a second speech signal from error signals indicative of a difference between a speech signal and a first synthesised speech signal for producing a second synthesised speech signal, forming a second set of speech parameters representative of the second synthesised speech signal, comparing the second set of speech parameters with a first set of speech parameters representative of the speech signal and forming a difference signal indicative of a difference between the first and second set of speech parameters, and adapting error signals corresponding to the difference in order to reduce the difference between the first and second set of speech parameters.

In a third aspect of the invention there is provided a speech encoder comprising a first parametrization module for forming first prediction parameters representative of a speech signal, an excitation generator for forming an excitation from samples stored in a code book, synthesis filters for forming a reconstructed speech signal corresponding to the excitation and the first prediction parameters, a second parametrization module for forming a second set of prediction parameters corresponding to the reconstructed speech signal, a comparison module for forming a comparison signal indicative of a difference between the first and second prediction parameters, and a control module for forming a control signal for the excitation generator, for controlling the formation of the excitation in such a way that the first and the second prediction parameters are as close as possible to each other and in a fourth aspect there is provided a method for speech encoding, comprising; synthesising a speech signal from a code selectable from a code book having a plurality of codes and a first set of speech parameters representative of the speech signal for producing a synthesised speech signal, forming a second set of speech parameters representative of the synthesised speech signal, comparing the first and second set of speech parameters and forming a difference signal indicative of a difference between them, and selecting the code from the code book in accordance with the difference signal to reduce the difference between the first and second set of speech parameters.

These have an advantage in that they efficiently code speech signals prior to transmission, and facilitate high quality decoding of such speech signals.

In a preferred embodiment when the first and second prediction parameters are substantially equal, the first prediction parameters are not transmitted to a decoder disposed in a receiver, which facilitates use by a decoder of parameter values calculated from a received speech signal, instead of the need for such parameters being transmitted from the encoder to the decoder.

In a fifth aspect of the invention there is provided a speech decoder comprising a synthesis filter module for forming first reconstructed speech corresponding to prediction parameters and modelling errors input to the decoder, a parametrization module for forming a second set of prediction parameters indicative of the reconstructed speech, a comparison module for forming a difference signal indicative of a difference between the first prediction parameters and the second prediction parameters, and a shaping module for processing the reconstructed speech signal, and in a sixth aspect there is provided a method for speech decoding, comprising; forming a synthesised speech signal from signals including a first set of speech parameters representative of a speech signal, defining a second set of speech parameters representative of the synthesised speech signal, comparing the first set of speech parameters with the second set of speech parameters and forming a difference signal indicative of a difference between them, and adapting the synthesised speech signal corresponding to the difference signal to reduce the difference between the first and second set of speech parameters.

The above aspects are practicable for parametric speech coders in which in addition to the parameters to be modelled for The speech, the modelling error is also transmitted to the receiver, and it should be suitable for use independent of what method is used to transmit the modelling error.

This invention is a new parametric speech coding system in which the parametrization according to the speech production model is carried out not only for the speech signal to be coded but also for the decoded, that is, synthesized speech signal. The parametric representation of the synthesized signal is compared with the parametric representation of the original speech signal and the coding functions are controlled in accordance with the difference between them.

The invention is applied in such a way that at first parametrization according to the speech production model used in encoding is carried out on the decoded speech signal. Next, parameter values formed from the synthesized speech signal are compared with the parameter values calculated in the encoder from the speech signal to be coded. In making the comparison some known distance measure can be used, for example, the Itakura-Saito measure between the frequency distances. The coding functions are controlled by the shaping block in such a way that the difference indicated by the distance measure is made to be as small as possible. In brief outline, an embodiment of the invention in accordance with the invention consists of three blocks: a parametrization block, a comparison block and a shaping block.

DETAILED DESCRIPTION OF EMBODIMENTS OF THE INVENTION

Embodiments in accordance with the invention are now described, by way of example only.

Figure 1A:
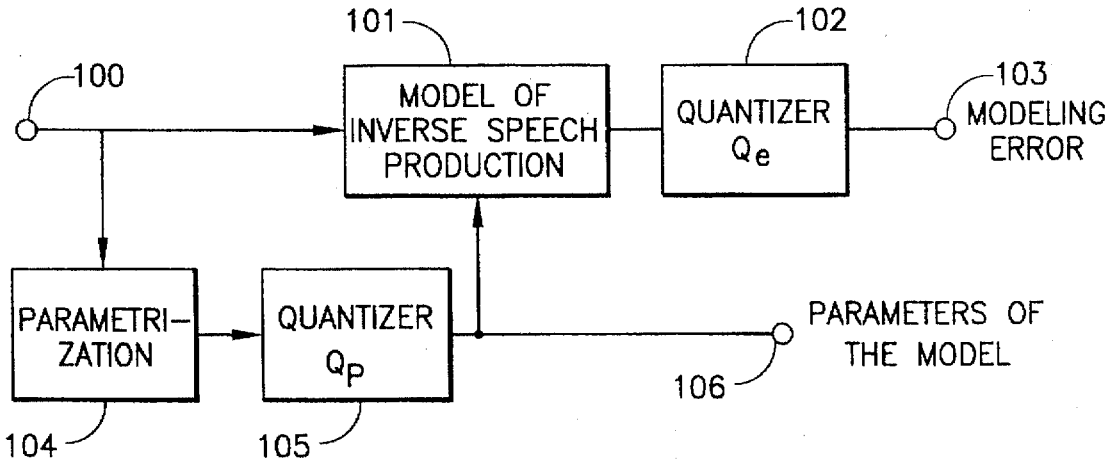
FIG.1a PRIOR ART
FIG. 1*a* shows an encoder of the speech coding system according to the prior art.
Figure 1B:
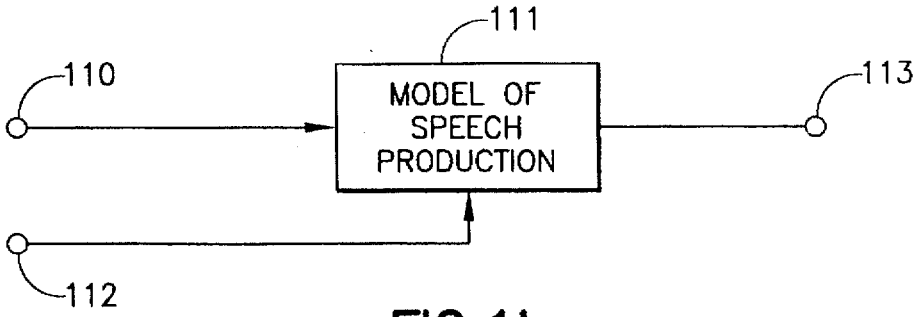
FIG.1b PRIOR ART
FIG. 1*b* shows a decoder of the speech coding system according to the prior art.

FIG. 1*a* presents an encoder (transmission side) of a known parametric speech coding system and FIG. 1*b* shows a decoder (receiving side). The speech coding system can be a hybrid coder representing a class that is generally referred to as an RELP coder (Residual Excited Linear Prediction) in the literature. In the encoder according to FIG. 1*a*, speech signal 100 that is input for coding and which is sampled, the samples being inserted in blocks, or frames, of a constant length, for example, 20 ms, undergoes a calculation of the values of the parameters of the speech production model used, this being carried out in parameter block 104. It is characteristic of parametric speech coding systems according to FIG. 1*a* that the calculation of the parameters describing the speech signal is carried out once for each speech frame that is approximately 20 ms in length. The parameter values according to the model are quantizod in quantization block 105. The quantized set of parameter values 106 that models the speech signal during each frame is transmitted to the decoder once per each frame.

In block 101 the speech signal undergoes inverse modelling of the speech production, which serves to form, by means of the model used, the difference of the synthesized signal and the original speech signal, that is, the modelling error that has arisen in the modelling. For modelling the speech signal, an appropriate model can be used, for example, the already mentioned LPC and LTP model. The invention does not place limitations on the model to be used. In calculating the modelling error that is to be carried out in block 101, quantized parameter values are used in block 105 so that the effect of the quantization on the parameters of the model is also taken into account.

In order to be able to produce a high quality speech signal in the receiver by using parametric speech coding, the modelling error that has resulted from use of the model must also be transmitted to the receiver. The modelling error formed in block 101 is quantized in block 102 and the quantized modelling error 103 is transmitted to the decoder.

FIG. 1*b* presents the structure of the decoder of a known parametric speech coding system. In the decoder the parameter values 112 of the speech production model, which are received via the transfer channel are supplied to speech production model 111. In speech production model 111, which in principle is a group of filters that synthesizes the speech signal, of which group the inverse filter is the block "inverse speech production model" of the encoder, the original speech signal 113 is formed by feeding to speech production model 111 the quantized modelling error 110 that has been received via the transfer channel. The encoder in FIG. 1*a* and the decoder in FIG. 1*b* thus form a coding system in such a way that the quantized modelling error 103 is brought to the decoder as an excitation 110 and the parameter values 106 of the speech production model, which have been calculated in the encoder, are brought to the decoder as parameter values 112, which are used in synthesizing the speech signal in accordance with the speech production model.

Figure 2:
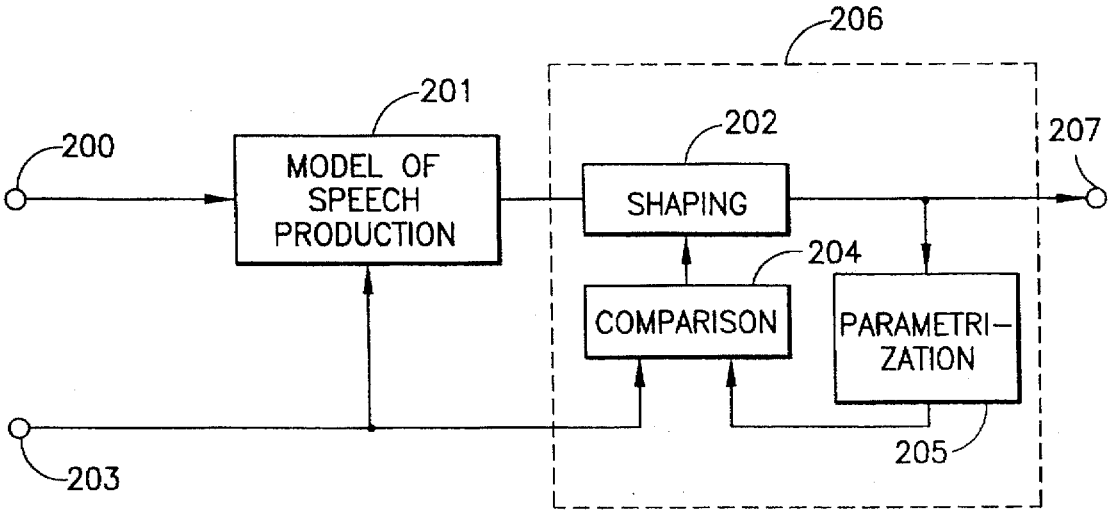
FIG. 2 is a schematic block diagram of a speech decoding system according to the invention.

FIG. 2 presents an embodiment for applying a method in accordance with the invention in a known decoder according to FIG. 1*b*. The system in accordance with the invention can be separated out from the known speech decoder to form block 206. A difference compared with the known decoding system is that in the system in accordance with the invention, parametrization is carried out on the decoded speech signal, that is, calculation of the parameter values according to the speech production model is also done on the decoded, that is, the synthesized speech signal and that the parameter values calculated from the decoded speech signal are used to shape the synthesized speech signal obtained from the speech production model. The decoded speech signal that is obtained from the speech production model which is used to synthesize the speech and is known per se—this should be a speech signal similar to the original one—is brought via shaping block 202 to parametrization block 205. The parametrization can be based on a known parametric model of the speech signal, for example, on LPC and LTP modelling. The operation of block 205 is the same as that of block 104 in FIG. 1*a*, that is, both form a parametric representation from the signal brought to it for the time of each speech frame.

The two sets of parameters that have been calculated are compared in comparison block 204: these are the original set of parameters 203 that was calculated in the encoder and received via the transfer channel as well as the set of parameters that was calculated in parametrization block 205 and calculated from the synthesized speech signal produced by speech production model 201. The result of comparing the sets of parameters that is carried out in comparison block 204 controls shaping block 202 in such a way that the objective in the shaping is to provide a shaping operation which ensures that the parameter values of the synthesized speech signal formed in the decoder and the parameter values 203 obtained from the encoder are to the largest possible extent of the same kind. In calculating the identity, some known method can be used such as, for example, calculation of the Itakura-Saito distance measure, whereby the parameters are close to each other when the distance indicated by the computed distance measure is as small as possible.

The invention does not place any conditions on shaping block 202. The operations to be carried out in it can be any suitable operations such as filtering operations, or the equivalent, that shape the envelope of the spectrum of the synthesized speech signal and its fine structure in order to minimize the distance indicated by the distance measure. Minimization of the distance measure is carried out empirically in such a way that for one decoded speech frame various shaping operations are tried out and by trial and error a search is made for a shaping operation which minimizes the distance measure used in the comparison as much as possible.

Figure 3:
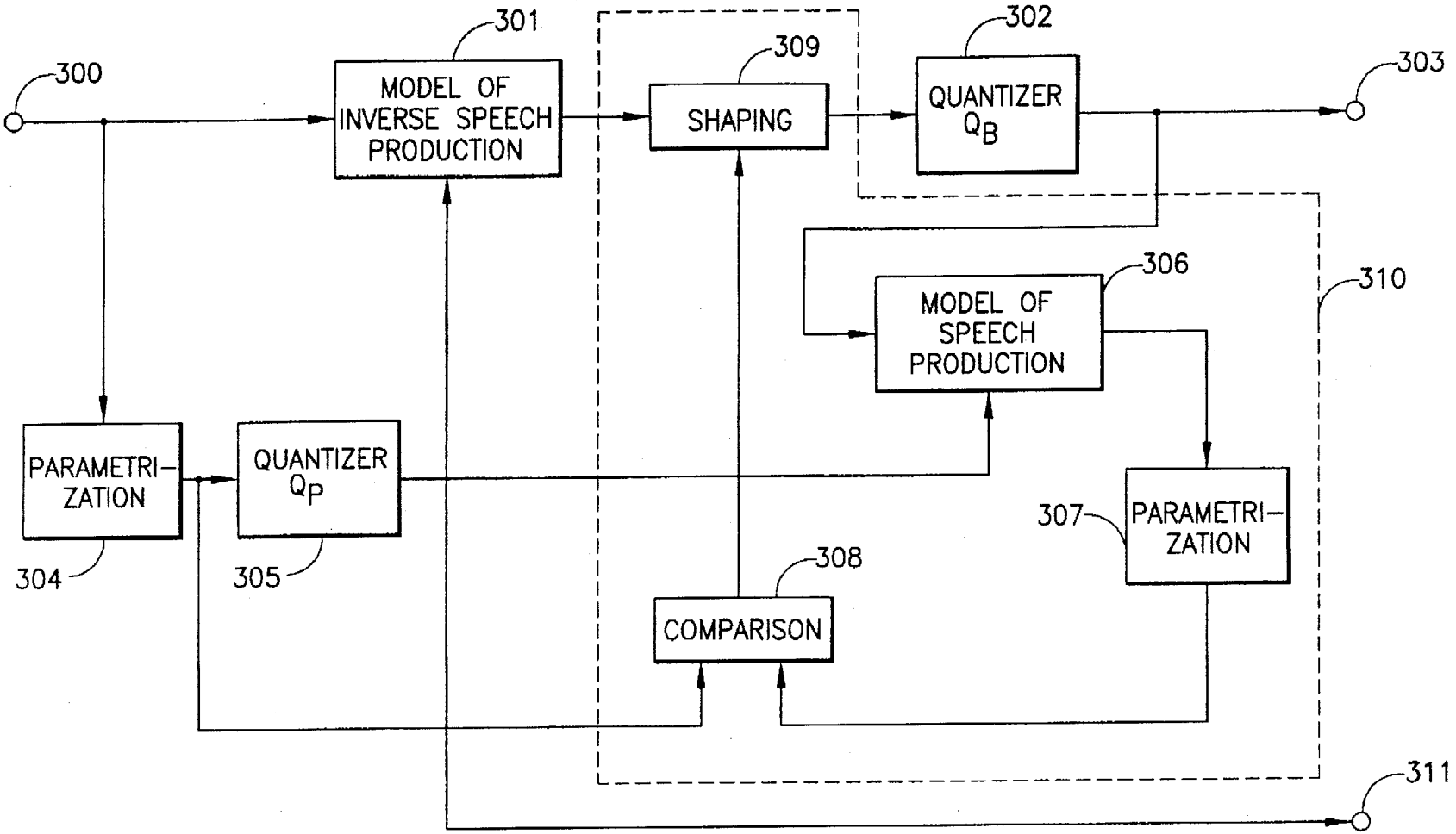
FIG. 3 shows a speech encoding system according to the invention.

FIG. 3 presents an embodiment for adapting a system in accordance with the invention in the encoder. The encoder can be an encoder of the RELP type and suitably may operate with the decoder in FIG. 2. The encoder in FIG. 3 differs from the encoder in FIG. 1*a* in respect of block 310, which is shown with a dashed line. In parametrization block 30*a*, a set of parameters according to a suitable speech production model is calculated from the speech signal 300 that is to be coded. The speech signal is brought to inverse modelling block 301, in which the prediction error is calculated, that is, the difference between the speech signal synthesized in accordance with the model and the speech signal that is to be coded. The error signal is quantized in block 302 and the quantized error signal 303 is transmitted ahead to the decoder. The parameter values according to the speech production model are quantized in block 305 and the quantized parameter values are utilized in block 301.

For encoding in accordance with the invention, the parameter values according to the speech production model are also calculated from the synthesized speech signal. For this purpose block 310 contains a speech production model 306, a parametrization block 307, a comparison block 308 and a shaping block 309.

The operation of block 310 is the following: first a reconstructed speech signal is formed again in speech production model 306 by feeding the quantized error signal 303 to the executing block (the inverse operation of block 301) of speech production model 306, in reconstructing the speech the quantized parameter values 311 are used.

In block 307 parametrization is again carried out on the reconstructed or synthesized speech signal. Parametrization block 307 carries out the same operation as blocks 304, 205 and 104. Similarly as in the decoder in FIG. 2, in the encoder according to FIG. 3 a comparison is made, in comparison block 308, of the parameter values calculated from the original speech signal, that is, the signal to be coded, and the parameter values calculated from the synthesized speech signal. In the comparison block the measure describing the difference between said two calculated sets of parameter values is formed and a control signal is formed in block 301 to be supplied to block 309 that shapes the modelling error that has been formed. Block 309 carries out a suitable operation, for example, filtering. By means of the control signal that is obtained from the comparison block, the operations to be carried out on the modelling error, which is obtained from inverse speech production modelling block 301, are shaped in such a way that the parameters of the speech production model (the parameters supplied by block 307), which are calculated from the synthesized speech signal, are to the greatest possible extent in accordance with the parameters calculated from the original speech signal (the parameters supplied by block 304).

Shaping block 309 can contain, in addition to filtering operations, operations that reduce the amount of samples to be transmitted. In accordance with the invention, the error signal is shaped in block 309 in such a way that by means of the quantized error signal and using speech production model 306, as much as possible of the parametric representation of the speech signal can be synthesized, which corresponds to the original speech signal, that is, the signal to be coded. In comparison block 308 a calculation is made in the encoder, of the distance measure between the parametric representations formed in blocks 304 and 307, and this distance measure is used to control the coding of the error signal that takes place in the encoding in such a way that it takes place in accordance with the speech production model used as well as possible, that is, in such a way that the parametric representation corresponding to the model is as similar as possible to the speech signal to be coded and to the synthesized speech signal. The operation of block 310 is carried out several times per one speech frame in such a way that in it the best possible shaping operation is sought on a trial and error basis. The sample values that have been found as a result of the best shaping operation that has been found are quantized and the quantized sample values (303) are transmitted ahead to the decoder.

The coding to be carried out on the speech signal can best be controlled by using an embodiment of the invention in the encoder in such a way that the difference between the parametric representations calculated from the synthesized speech signal and the speech signal to be coded is very small, whereby the parameter values of the speech production model need not be quantized at all and transmitted to the decoder. However, in the speech production model to be used in the decoder, parameter values calculated from the synthesized speech signal formed in the decoder can be used. In this kind of system the quantized set of parameter values 311 is not forwarded to the decoder at all.

Figure 4:
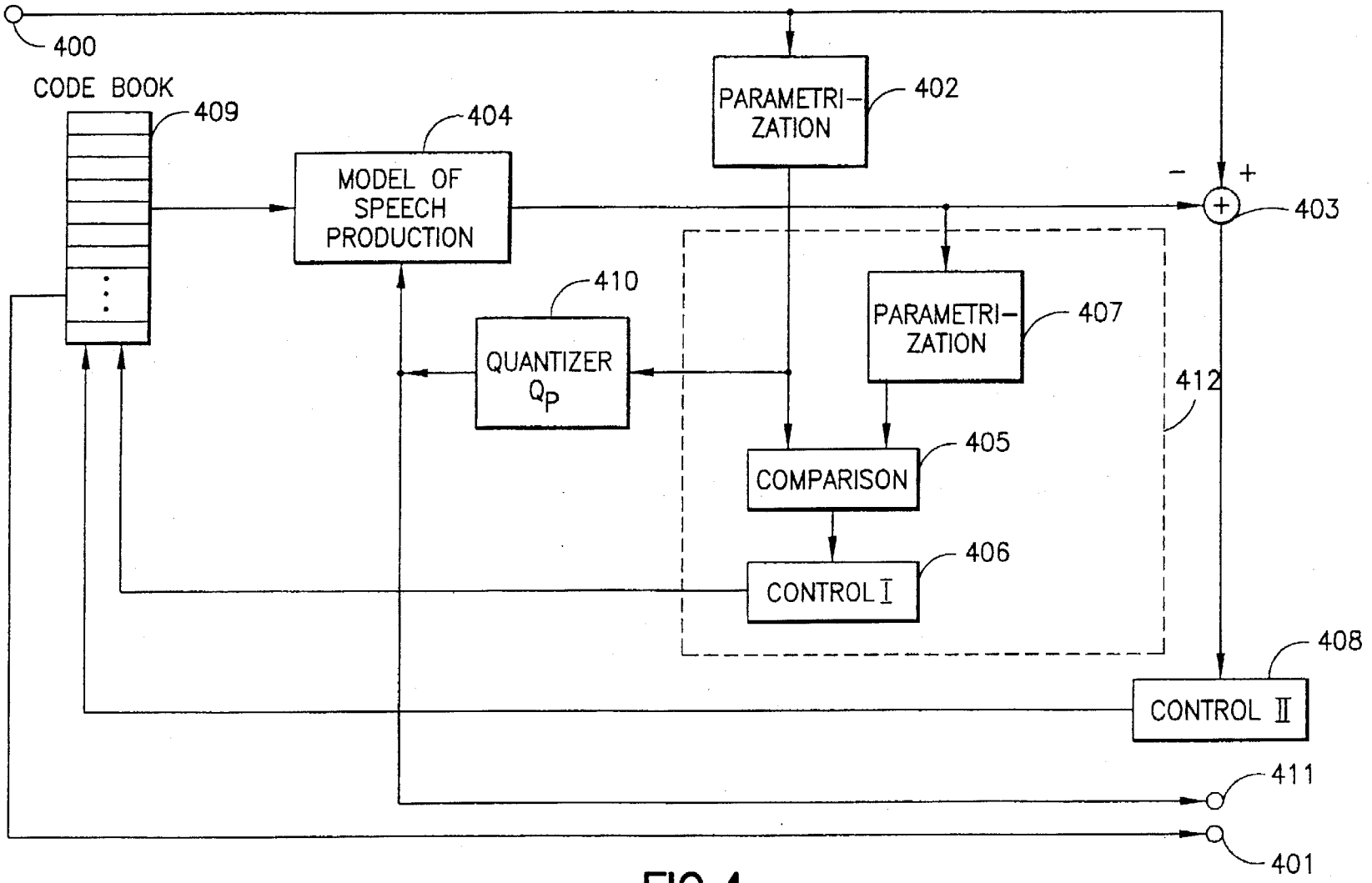
FIG. 4 shows a speech encoding system that operates on the analysis-synthesis principle according to the invention.

FIG. 4 shows another embodiment of an encoding system in accordance with the invention. FIG. 4 shows an embodiment of the invention combined with a speech coder of the analysis-synthesis type. The coder can be a coder of the CELP type. In a coding system of this type, quantization of the modelling error signal is carried out by the so-called analysis-synthesis method in which the encoding involves seeking a quantized representation of the modelling error by synthesizing the speech signal, that is, using the speech production model. In this coding system any quantized representations of the modelling error can be stored, for example, in a code book. Synthesis filtering is an essential part of the encoding.

The operating principle in systems of this type is to make a search for the best representation of the modelling error signal in such a way that the synthesized speech signal corresponding to each possible quantized modelling error that is stored in code book 409 is formed in speech production model 404, and a difference signal between the synthesized and the original speech signal 400, which is being coded, is formed in subtraction block 403. Control block 408 selects the smallest vector 401 between the signals, which has produced the difference signal and been stored in the code book, for forwarding to the decoder. Parametrization of speech signal 400 that has been input for coding is carried out in block 402. The set of parameters thus formed, which is in accordance with the speech production model, is quantized in block 410 and the quantized parameter values are used in the speech production modelling 404. The representation 401 that best resembles the signal that is to be coded and which has formed the synthesized speech signal and been stored in the code book is selected for forwarding to the receiver.

When a system in accordance with the invention is put into use in the above-described known analysis-synthesis encoders, the synthesizing embodied in the structure of the encoder can be utilized in the manner shown in block 412, which is marked with a dashed line in FIG. 4. In block 412 parametrization is first carried out on the speech signal in block 407. The operation of parametrization block 407 is the same as the operation of block 402 and the set of parameters formed in it in accordance with the speech production model is compared with the set of parameters formed from the speech signal to be coded in parametrization block 402. The comparison is carried out by calculating the distance measure between the parametric representations of the speech production model, (eg, the Itakura-Saito measure) in comparison block 405. The operation of comparison block 405 corresponds to the operation of block 308 in FIG. 3 as well as the operation of block 204 in FIG. 2.

As in the encoder according to FIG. 3, in the encoder shown in FIG. 4 the coding of the error signal is controlled by means of the control signal formed as the result of the comparison in such a way that the parameters of the speech production model calculated from the synthesized speech signal conform as much as possible to the parameters calculated from the original speech signal. Because in the analysis-synthesis system quantization of the error signal is carried out by synthesizing different speech signals corresponding to quantized representations of the modelling error, the difference between the model and the original speech signal, that is the error signal, is not formed at all in the encoder. For this reason a corresponding shaping operation cannot be carried out on the modelling error, as was done in the encoder in FIG. 3 by means of block 309. Control of the quantization of the error signal in accordance with the invention is thus carried out according to the parametric representation of the signal to be coded and the synthesized signal by means of control block 406, which controls searches made in the code book.

As in the encoder shown in FIG. 3, in the encoder in FIG. 4 also coding to be carried out on the speech signal can be controlled to the extent that the difference, to be formed in comparison block 308, between the parametric representations calculated from the synthesized speech signal and the speech signal to be coded is very small. In this case the parameter values of the speech production model need not be quantized and forwarded to the decoder at all, but instead the parameter values calculated from the synthesized speech signal that is formed in the decoder can be used in the decoder. In a system of this kind the quantized set of parameter values 411 is not forwarded to the decoder at all.

The invention can be implemented in a number of different ways as an adjunct to known encoders and decoders, nevertheless remaining within the scope of protection defined by the accompanying claims. The shaping operations to be carried out according to the control of the comparison block can be any suitable operations, as can the control method used to control the code book.

By means of the invention, the quality of the speech signal produced by a coding system based on parametric speech coding can be improved first of all in the receiver by combining the system in accordance with the invention with the decoding. Second, the invention can also be applied in carrying out the encoding on the transmission side, thereby achieving a coding of the error signal that is efficient from the standpoint of the speech production model.

In a data communications system, a system in accordance with the invention can be used either in the encoding to be carried out on the transmission side or in the decoding to be carried out on the receiving end or in both. On the receiving end the quality of the speech signal produced by a speech coding system based on parametric speech coding can be improved by combining a system in accordance with the invention with the decoding. On the transmission side an embodiment of the invention can also be applied-in carrying out the encoding, thereby achieving efficient coding of the error signal of the parametric model in general in a digital data communication system, a system in accordance with the invention can be used either in the encoding to be carried out on the transmission side or in the decoding to be carried out at the receiving end or in both.

The scope of the present disclosure includes any novel feature or combination of features disclosed therein either explicitly or implicitly or any generalisation thereof irrespective of whether or not it relates to the claimed invention or mitigates any or all of the problems addressed by the present invention. The applicant hereby gives notice that new claims may be formulated to such features during prosecution of this application or of any such further application derived therefrom.

What I claim is:

1. A speech encoder, comprising:

a first parametrization module for determining first prediction parameters corresponding to a speech signal input thereto;

an analysis filter module for determining a modeling error corresponding to the speech signal and first prediction parameters, a synthesis filter module for forming a reconstructed speech signal corresponding to the modeling error and the first prediction parameters, a second parametrization module for determining a second set of prediction parameters corresponding to the reconstructed speech signal, a comparison module for forming a comparison signal indicative of a difference between the first and second prediction parameters, and a shaping module for shaping the modelling error such that the difference between the first and second prediction parameters is reduced.

2. A speech encoder according to claim 1, wherein the first prediction parameters and modeling error are quantized.

3. A speech encoder according to claim 1, wherein for each speech signal, the shaping module carries out several different shaping operations.

4. A speech encoder according to claim 1, wherein the comparison module produces a comparison signal using a distance measure that is known per se.

5. A speech encoder according to claim 4, wherein the distance measure is the Itakura-Saito measure between the frequency representations of the input signals.

6. A speech encoder according to claim 1, wherein the shaping part processes the quantization of the modeling error in the quantization block.

7. A speech encoder according to claim 1, wherein the shaping module carries out non-linear signal processing, which can also involve processing that reduces the amount of samples.

8. A speech encoder according to claim 1, wherein the second parametrization module utilizes the same algorithms as the first parametrization module.

9. A speech encoder according to claim 1, wherein when the first and second prediction parameters are substantially equal, the first prediction parameters are not transmitted to a decoder disposed in a receiver.

10. A speech decoder, comprising:

a synthesis filter module for forming first reconstructed speech corresponding to prediction parameters and modeling errors input to the decoder, a parametrization module for forming a second set of prediction parameters indicative of the reconstructed speech, a comparison module for forming a difference signal indicative of a difference between the first prediction parameters and the second prediction parameters, and a shaping module for processing the reconstructed speech signal.

11. A speech decoder according to claim 10, wherein for each speech signal, the shaping module carries out a number of different shaping operations so as to determine a shaping operation for minimizing the difference signal.

12. A speech encoder, comprising:

first parametrization means for forming first prediction parameters representative of a speech signal, excitation generator means for forming an excitation from samples stored in a code book, a plurality of synthesis filter means for forming a reconstructed speech signal corresponding to the excitation and the first prediction parameters, second parametrization means for forming a second set of prediction parameters corresponding to the reconstructed speech signal, comparison means for forming a comparison signal indicative of a difference between the first and second prediction parameters, and control means for forming a control signal for the excitation generator means, for controlling the formation of the excitation in such a way that the first and the second prediction parameters are as close as possible to each other.

13. A speech encoder according to claim 12, further comprising means for forming a weighted difference between the reconstructed speech signal and an original speech signal, and for searching for a minimum difference whereby the first prediction parameters as well as the excitation gives a minimum difference.

14. A speech coder according to claim 12, wherein the second parametrization means utilizes the same algorithms as the first parametrization means.

15. A method for speech encoding, comprising steps of:

synthesizing a second speech signal from error signals indicative of a difference between a speech signal and a first synthesized speech signal for producing a second synthesized speech signal, forming a second set of speech parameters representative of the second synthesized speech signal, comparing the second set of speech parameters with a first set of speech parameters representative of the speech signal and forming a difference signal indicative of a difference between the first and second set of speech parameters, and adapting error signals corresponding to the difference in order to reduce the difference between the first and second set of speech parameters.

16. A method for speech decoding, comprising steps of:

forming a synthesized speech signal from signals including a first set of speech parameters representative of a speech signal, defining a second set of speech parameters representative of the synthesized speech signal, comparing the first set of speech parameters with the second set of speech parameters and forming a difference signal indicative of a difference between them, and adapting the synthesized speech signal corresponding to the difference signal to reduce the difference between the first and second set of speech parameters.

17. A method for speech encoding, comprising steps of:

synthesizing a speech signal from a code selectable from a code book having a plurality of codes and a first set of speech parameters representative of the speech signal for producing a synthesized speech signal, forming a second set of speech parameters representative of the synthesized speech signal, comparing the first and second set of speech parameters and forming a difference signal indicative of a difference between them, and selecting the code from the code book in accordance with the difference signal to reduce the difference between the first and second set of speech parameters.

* * * * *